US007538638B2

(12) United States Patent
Hidaka et al.

(10) Patent No.: US 7,538,638 B2
(45) Date of Patent: May 26, 2009

(54) RESONATOR, FILTER, AND COMMUNICATION UNIT

(75) Inventors: Seiji Hidaka, Nagaokakyo (JP); Shin Abe, Muko (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 209 days.

(21) Appl. No.: 10/558,158

(22) PCT Filed: Mar. 10, 2004

(86) PCT No.: PCT/JP2004/003062

§ 371 (c)(1),
(2), (4) Date: Nov. 23, 2005

(87) PCT Pub. No.: WO2004/114455

PCT Pub. Date: Dec. 29, 2004

(65) Prior Publication Data

US 2007/0013465 A1 Jan. 18, 2007

(30) Foreign Application Priority Data

Jun. 18, 2003 (JP) ..... 2003-173745

(51) Int. Cl.
*H01P 1/20* (2006.01)

(52) U.S. Cl. ..... 333/202; 333/219.1

(58) Field of Classification Search ..... 333/202, 333/219.1

See application file for complete search history.

(56) References Cited

U.S. PATENT DOCUMENTS 5,040,092 A * 8/1991 Katho et al. ..... 361/321.2
5,479,141 A * 12/1995 Ishizaki et al. ..... 333/204
5,831,495 A * 11/1998 Hino ..... 333/202
6,172,572 B1 * 1/2001 Kajikawa et al. ..... 331/96

(Continued)

FOREIGN PATENT DOCUMENTS

JP 9-246821 3/1996

(Continued)

OTHER PUBLICATIONS

Design & Analysis of Fin Lines/Fin-line Resonators Table 7.1 pp. 316-317.
Design & Analysis of Fin Lines/Fin-line Resonators pp. 168-169.

*Primary Examiner*—Benny Lee
*Assistant Examiner*—Gerald Stevens
(74) *Attorney, Agent, or Firm*—Dickstein Shapiro LLP

(57) ABSTRACT

A resonator, a filter, and a communication apparatus that can be easily miniaturized even if the resonant frequency is relatively low are provided. Conductor layers are laminated in the state in which they are partially insulated from each other by a dielectric layer. Conductor openings free from any conductor layer in the laminate direction serve as inductive areas, and the portion where the conductor layers oppose each other with the dielectric layer therebetween serves as a capacitive area CA. With this configuration, the resulting resonator serves as a stepped-impedance-structured slot resonator. By increasing the impedance step ratio of the capacitive area to the inductive areas according to this structure, the resonator is miniaturized. Additionally, the conductor loss of the resonator is reduced by suppressing the intrusion of magnetic field energy to the capacitive area. It is thus possible to obtain a small resonator having high Qo.

19 Claims, 13 Drawing Sheets

U.S. PATENT DOCUMENTS

| | | | | |
|---|---|---|---|---|
| 6,201,456 | B1 * | 3/2001 | Hiratsuka et al. | 333/134 |
| 6,400,239 | B1 * | 6/2002 | Chun et al. | 333/206 |
| 2002/0109562 | A1 * | 8/2002 | Tsukamoto et al. | 333/134 |
| 2004/0021531 | A1 * | 2/2004 | Mukaiyama et al. | 333/202 |

FOREIGN PATENT DOCUMENTS

| | | |
|---|---|---|
| JP | 11-312903 | 10/1998 |

* cited by examiner

RESONATOR, FILTER, AND COMMUNICATION UNIT

TECHNICAL FIELD

The present invention relates to a resonator, a filter, and a communication apparatus which are used, for example, for microwaves or millimeter wave wireless communication or for sending and receiving electromagnetic waves.

BACKGROUND ART

To reduce the size of a resonator using a slot line, a design approach of forming the slot line in a stepped impedance structure is already known (for example, see "ANALYSIS, DESIGN AND APPLICATIONS OF FIN LINES", Bharathi Bhat, Shiban K. Koul, PP. 316-317 published by ARTECH HOUSE, INC, U.S.A. 1987, and "MAIKUROHA KAIRO NO KISO TO OHYO (BASICS AND APPLICATIONS OF MICROWAVE CIRCUITS), Yoshihiro KONISHI, Sougou Denshi Shuppannsha, p. 169 issued in 1990 (first edition). By forming the widths of both ends of the slot line to be larger and by forming the width of the central portion to be narrower, the impedance of both ends of the slot line becomes inductive and the impedance of the central portion becomes capacitive so that the impedance is changed in this approach, in a stepwise manner along the length of the slot line. The length of the slot line required for obtaining the same resonant frequency can be reduced with this arrangement.

A typical example of the above-described stepped-impedance-structured slot resonator is shown in FIG. 13B, a top view illustrating a substrate forming the slot resonator, and FIG. 13A, a sectional view taken along line A-A in FIG. 13B. A conductive film 10 having conductor openings APa, APb, and APc is formed on the top surface of a dielectric substrate 1. The conductor openings APa, APb, and APc form one conductor opening formed, as a whole, in a dumbbell shape. The widths (which can also be referred to as "diameters" since the openings APa and APb in this example are circular) of the conductor openings APa and APb at both ends are formed relatively large and the width of the central conductor opening APc is relatively small. Accordingly, both ends of the slot are inductive, while the central portion of the slot is capacitive.

The broken lines in FIG. 13A schematically indicate magnetic lines of force of this slot resonator. The magnetic distribution of this resonator is represented by the magnetic lines of force. In the stepped-impedance-structured slot resonator, magnetic field vectors are directed upward in the inductive area at one end, while magnetic field vectors are directed downward in the other inductive area at the other end, and the overall slot resonator serves as a magnetic dipole. Magnetic field energy produced by the resonance operation mostly concentrates in the inductive areas formed by the conductor openings APa and APb, while electric field energy is mostly distributed in the capacitive area formed by the conductor opening APc. In this manner, the slot resonator serves as a lumped-constant circuit by separating the storage area of the magnetic field energy from the storage area of the electric field energy, thereby achieving the miniaturization of the slot resonator.

The size of the slot resonator is inversely proportional to the resonant frequency. Accordingly, forming a slot resonator into a stepped-impedance structure as described above is effective in reducing the size of the resonator when the resonant frequency is relatively low. Additionally, a larger impedance step ratio of the capacitive area to the inductive areas is more effective in reducing the size of the resonator.

In the example shown in FIG. 13B, therefore, it is effective if the line width of the conductor opening APc is formed to be narrow and if the line length is reduced. However, because of a restriction on the pattern forming precision of the conductive film, the line width cannot be formed to be extremely narrow. Additionally, a change in the capacitance of the capacitive area caused by dimensional variations in the line width becomes noticeable as the line width becomes narrower. Thus, it is more difficult to obtain a predetermined resonant frequency with high precision as the line width of the conductor opening APc in the capacitive area becomes narrower.

To solve the above-described problems, it is an object of the present invention to provide a resonator, a filter, and a communication apparatus that can be easily miniaturized even if the resonant frequency is relatively low.

DISCLOSURE OF INVENTION

According to this invention, a resonator including a dielectric layer and conductor layers is provided. A plurality of conductor layers partially insulated from each other by the dielectric layer, and at least two openings free from any of the conductor layers in the direction in which the dielectric layer and the conductor layers are laminated are formed as inductive areas, and a portion where the conductor layers oppose each other with the dielectric layer therebetween in the laminate direction, the portion being interposed between the inductive areas, is formed as a capacitive area.

With this configuration, a plurality of conductor layers are laminated with the dielectric layer therebetween, and conductor openings are formed by the conductor layers, and a capacitive area is formed in a portion where the conductor layers oppose each other in the laminate direction with the dielectric layer therebetween. Accordingly, a predetermined capacitance is generated in a limited area, and a small resonator exhibiting a highly precise resonant frequency can be obtained.

In this invention, a plurality of the inductive areas and a plurality of the capacitive areas may be disposed in a laminated body including the dielectric layer and the conductor layers, and a plurality of sets, each set including the inductive areas and the capacitive area interposed between the inductive areas, may be disposed. According to this structure, a plurality of resonators can be formed on a single substrate, which serves as the laminated body, and also, by coupling those resonators, a resonator device including a plurality of stages of resonators can be formed.

According to this invention, a filter including the above-described resonator and signal input/output means coupled to the resonator is also provided. According to this structure, a small filter can be obtained.

According to this invention, a communication apparatus including the above-described resonator or filter is provided. By the provision of this filter, the size of a high-frequency circuit portion including the above-described resonator or filter can be reduced, thereby obtaining a small communication apparatus.

BEST MODE FOR CARRYING OUT THE INVENTION

Examples of resonators, filters, duplexers, and communication apparatuses according to the present invention are described below with reference to the accompanying drawings.

A resonator according to a first embodiment is discussed below with reference to FIG. 1.

Figure 1A:
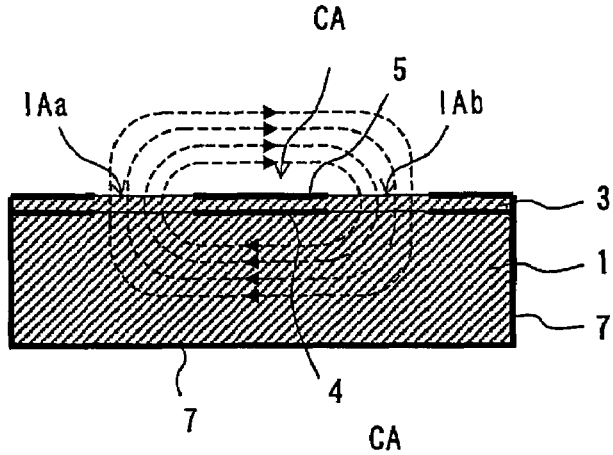
FIGS. 1A to 1D illustrate the configuration of a resonator according to a first embodiment.
Figure 1B:
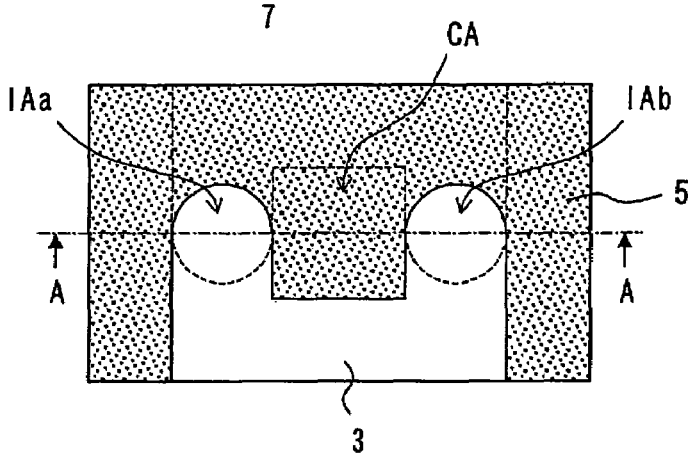
Figure 1C:
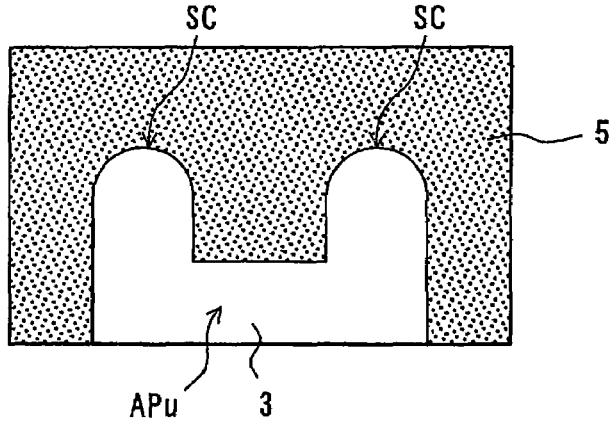
Figure 1D:
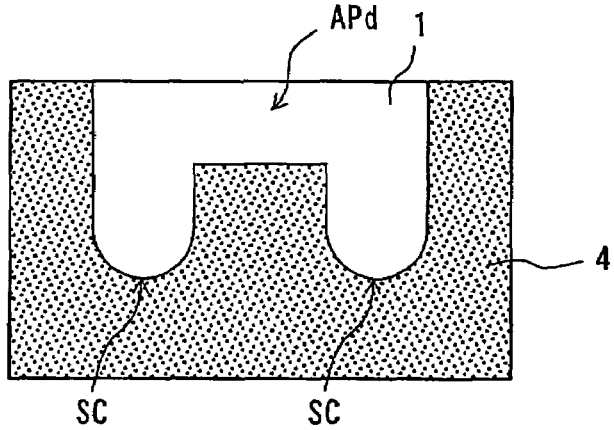

FIG. 1B, is a top view illustrating the resonator, FIG. 1A is a sectional view taken along line A-A in FIG. 1B, FIG. 1C illustrates the pattern of a conductor layer disposed on the top surface, and FIG. 1D illustrates the pattern of a conductor layer pattern disposed as the bottom layer.

On the top surface of a rectangular dielectric substrate 1, a conductor layer 4 having the pattern shown in FIG. 1D is formed. A dielectric layer 3 is disposed on the entire top surface of the dielectric substrate 1 on which the conductor layer 4 is formed, and a conductor layer 5 having the pattern shown in FIG. 1C is formed on the surface of the dielectric layer 3. (See FIG. 1A) With this configuration, a structure in which the conductor layers 4 and 5 are laminated in the thickness direction with the dielectric layer 3 therebetween is formed. In the state in which the conductor layers 4 and 5 are laminated with the dielectric layer 3 therebetween, conductor openings free from any conductor layer are formed, as shown in FIG. 1A, in the direction in which the conductor layers 4 and 5 and the dielectric layer 3 are laminated.

In this example, by combining semicircular portions SC of a conductor opening APd formed by the pattern of the conductor layer 4 and semicircular portions SC of a conductor opening APu formed by the pattern of the conductor layer 5, circular conductor openings free from any conductor layer in the laminate direction are formed. Those circular conductor openings form inductive areas IAa and IAb.

By the lamination of the conductor layers 4 and 5, a rectangular capacitive area CA is formed in a portion where the inductive areas IAa and IAb face each other with the dielectric layer 3 therebetween. The thickness (gap) of the dielectric layer 3 is set to be 1/10 of the diameter of the circular conductor openings or smaller.

According to this structure, the two inductive areas IAa and IAb and the capacitive area CA interposed between the inductive areas IAa and IAb serve as a stepped-impedance-structured slot resonator. In this example, since the ratio of the gap of the capacitive area CA to the diameter of the conductor openings is 1:10 or greater, about 90% or more of magnetic field energy produced by the resonance operation is distributed in the inductive areas IAa and IAb and about 90% or more of electric field energy is distributed in the capacitive area CA.

The broken lines in FIG. 1A schematically represent magnetic lines of force, the shape of which indicate the magnetic field distribution. Magnetic field vectors are directed upward in one inductive area at one end, while magnetic field vectors are directed downward in the other inductive area at the other end so that the magnetic fields are symmetrically distributed with respect to a point substantially at 180°. The electric field vectors are distributed while being aligned in the dielectric layer sandwiched between the conductor layers in the capacitive area CA.

If a high capacitance, such as a lumped constant, is obtained in the capacitive area CA, a current having a small amplitude change is distributed around the inductive areas IAa and IAb so that the edge effect in the capacitive area can be alleviated. More specifically, magnetic field vectors are distributed around the capacitive area CA, as indicated in FIG. 1A. However, a current without nodes or loops flows at the edges of the conductor openings forming the inductive areas IAa and IAb, and by the influence of this current, the magnetic fields surrounding the capacitive area CA are expanded so that the curvature becomes gentler, thereby alleviating the edge effect (generated by the sharp curvature of magnetic fields). Accordingly, the conductor loss is suppressed, and as a result, a resonator having high Qo can be obtained.

Figure 13A:
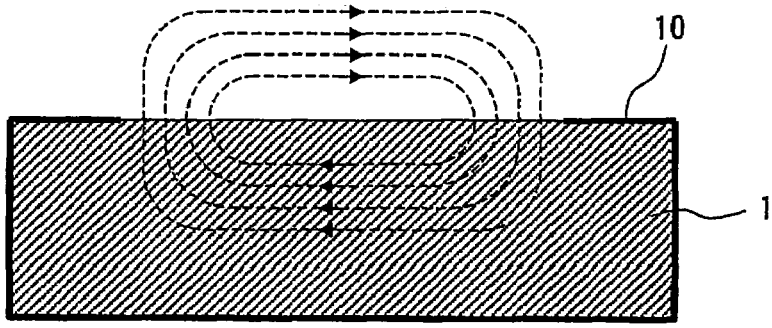
FIG. 13A PRIOR ART
FIGS. 13A and 13B illustrates the configuration of a known resonator.
Figure 13B:
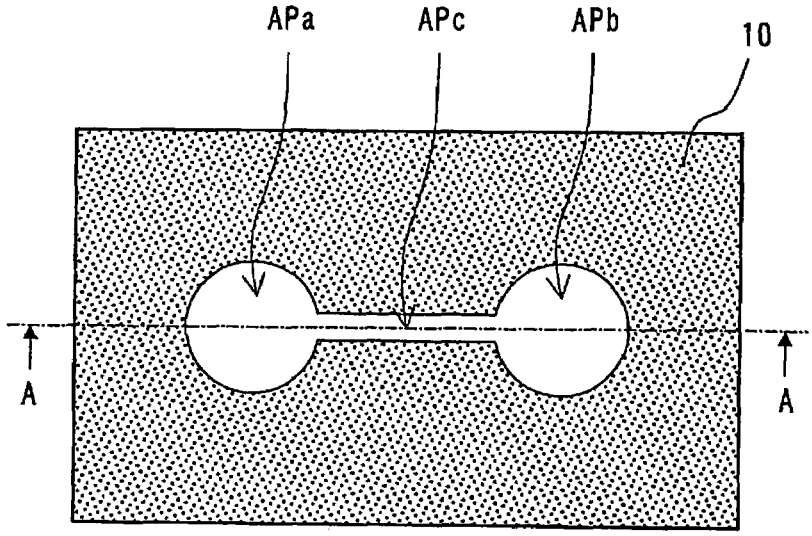
FIG. 13B PRIOR ART

Unlike the known dumbbell-shaped slot resonator shown in FIG. 13B, since the capacitive area CA is formed in a portion where the two conductor layers 4 and 5 oppose each other with the dielectric layer 3 therebetween in the thickness direction, a predetermined capacitor can be formed in a limited area. As a result, the overall resonator can be miniaturized. Additionally, the capacitive area CA is not open when viewed in the laminate direction, and instead, the predetermined portions of the conductor layers 4 and 5 oppose each other in the thickness direction with the dielectric layer 3 therebetween. Accordingly, the volume ratio of the capacitive area CA to the entire resonance space can be decreased, thereby reducing the occurrences of intrusion of the magnetic field energy. That is, the relationship, i.e., the magnetic field energy=volume×magnetic field energy density, holds true, and thus, the amount of magnetic field energy becomes smaller as the volume of the capacitive area is smaller. The presence of the magnetic field energy in the capacitive area causes an actual current to flow to maintain such energy, thereby incurring the conductor loss. Accordingly, the conductor loss can be reduced as the magnetic field energy in the capacitive area is smaller. It is thus possible to obtain a small resonator having high unloaded Q (Qo).

In the example shown in FIG. 1A, a shielding electrode 7 is disposed on the four side surfaces and bottom surface of the dielectric substrate 1, and the peripheral portions of the conductor layers 4 and 5 are electrically connected to the shielding electrode 7. Accordingly, the lower half of the above-described resonance space is shielded by the shielding electrode 7. The upper half of the resonance space may also be shielded by covering the top portion of the resonator in the state shown in FIG. 1A with a conductive cap. As a result, the entire resonance space can be shielded by the conductive cap and the shielding electrode 7.

The shielding electrode 7 is not essential since it does not directly influence the resonance operation. If necessary, a structure in which the shielding electrode 7 is not disposed on the dielectric substrate 1 may be formed.

Figures 2A, 2B, 2C, 2D, 2E:
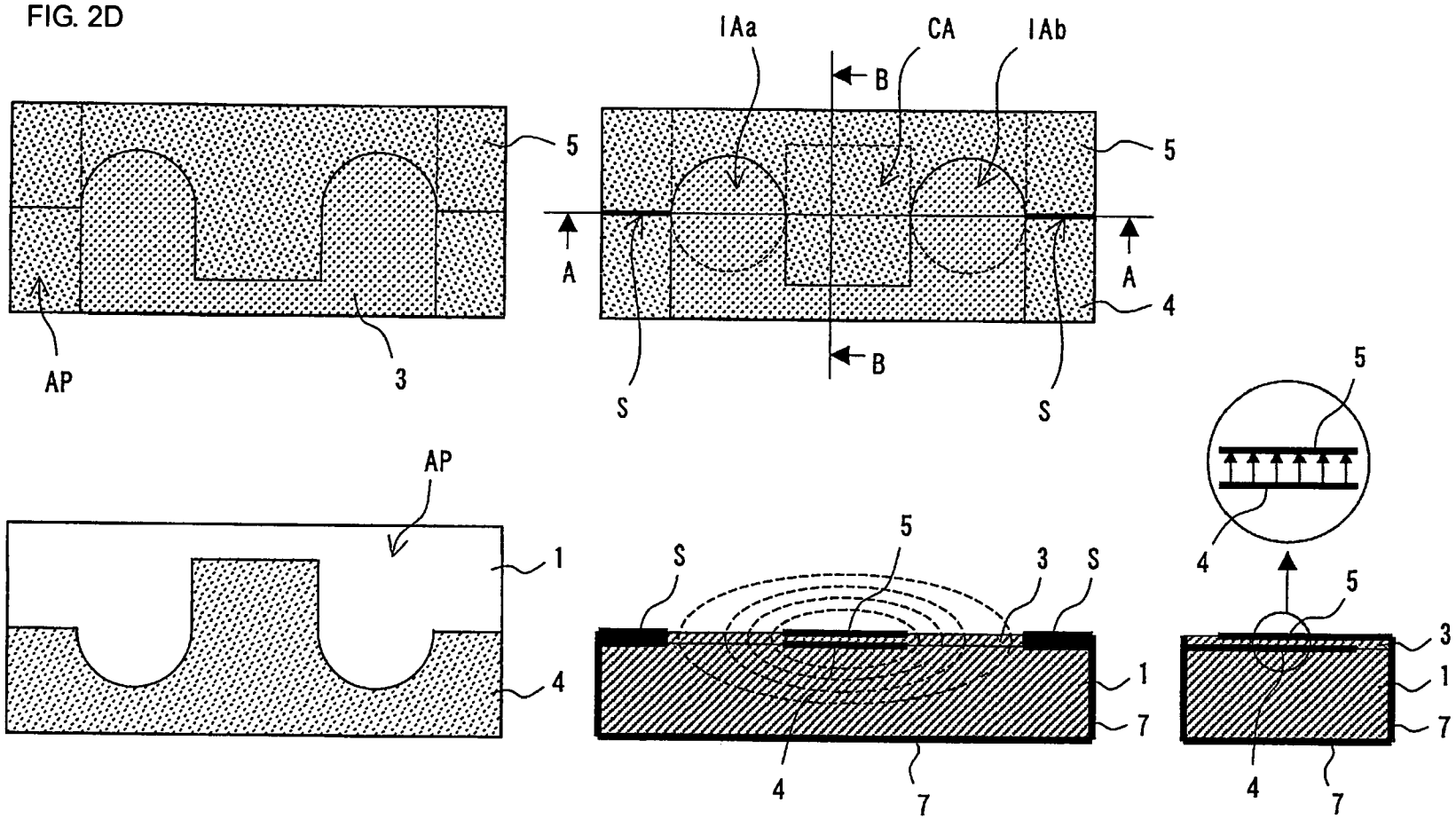
FIGS. 2A to 2E illustrate the configuration of a resonator according to a second embodiment.

FIGS. 2A to 2E illustrates the configuration of a resonator according to a second embodiment. FIG. 2C, is a top view illustrating the resonator, FIG. 2A is a sectional view taken along line A-A in FIG. 2C, and FIG. 2B is a sectional view taken along line B-B in FIG. 2C. FIG. 2D, illustrates the pattern of a conductor layer 5 as the upper layer, and FIG. 2E illustrates the pattern of a conductor layer 4 as the lower layer. Unlike the resonator shown in FIGS. 1A to 1D, the conductor layers 4 and 5 in this embodiment are partially electrically connected to each other by interlayer short-circuit portions S on the top surface of the dielectric substrate 1. The dielectric layer 3 is not present in the interlayer short-circuit portions S. According to this structure, the conductor layers 4 and 5 are short-circuited more reliably in the vicinities of the conductor openings by the interlayer short-circuit portions S compared to the structure in which the conductor layers 4 and 5 are short-circuited only by the shielding electrode 7.

Figure 3C:
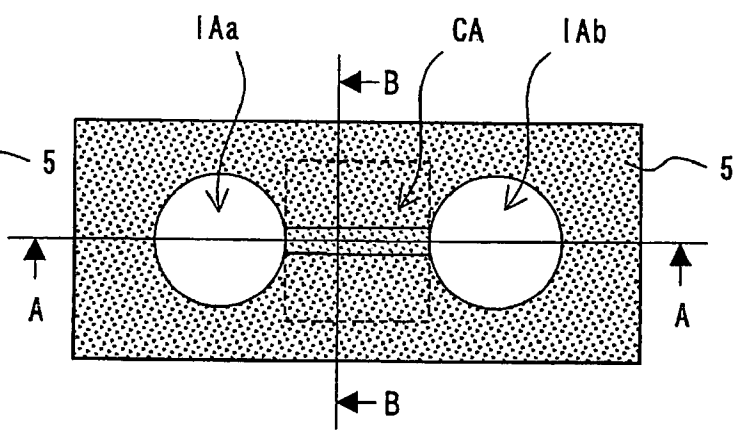
FIGS. 3A to 3E illustrate the configuration of a resonator according to a third embodiment.
Figure 3D:
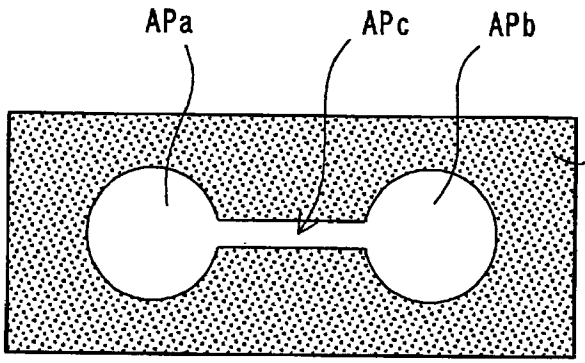
Figure 3B:
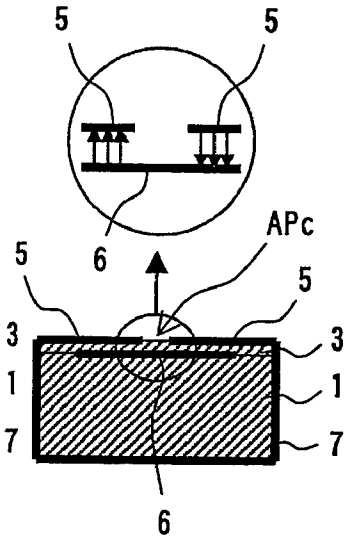
Figure 3A:
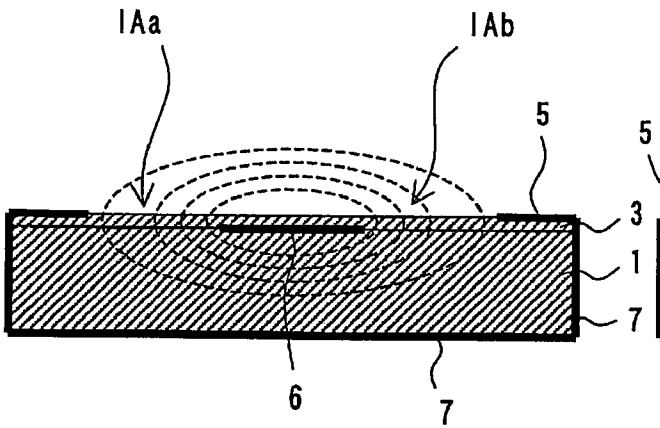
Figure 3E:
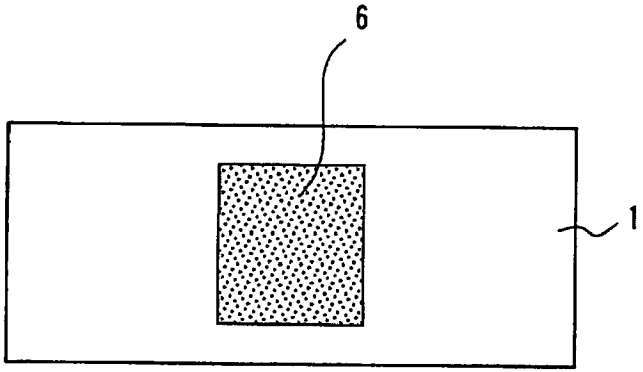

FIGS. 3A to 3E illustrates the configuration of a resonator according to a third embodiment. FIG. 3C, is a top view illustrating the resonator, FIG. 3A is a sectional view taken along line A-A in FIG. 3C, and FIG. 3B is a sectional view taken along line B-B in FIG. 3C. FIG. 3D, illustrates the pattern of a conducive layer 5 as the upper layer, and FIG. 3E illustrates the pattern of a conductor layer 6 as the lower layer.

The conductor layer 6 is formed in a predetermined portion on the top surface of the dielectric substrate 1. The conductor layer 5 having the pattern shown in FIG. 3D is formed on the top surface of the conductor layer 6 with the dielectric layer 3 therebetween. The conductor opening of the conductor layer 5 is formed in a dumbbell shape in which generally circular conductor openings APa and APb are formed at both ends and a slot conductor opening APc having a predetermined width is interposed between the conductor openings APa and APb. The conductor layer 6 is formed in a position near the slot conductor opening APc where the conductor layer 6 does not face the conductor openings APa and APb, which serve as inductive areas, formed at both ends. The conductor layers 5 and 6 oppose each other with the dielectric layer 3 therebetween, and capacitances are generated between the conductor layers 5 and 6, as shown in FIG. 3B. This corresponds to an equivalent circuit in which two capacitors are connected in series with each other. Accordingly, a required capacitance can be ensured without the need to form the gap of the slot opening APc to be extremely small. As a result, as in the first and second embodiments, a small resonator having high Qo can be obtained. By laminating a plurality of conductor layers 5 and 6 alternately, larger capacitances can be obtained.

A fourth embodiment is described below with reference to FIGS. 4 through 6.

Figure 4C:
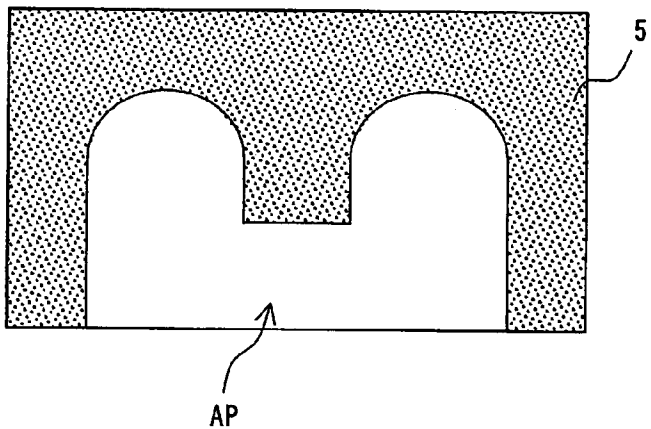
FIGS. 4A to 4D illustrate the configuration of a resonator according to a fourth embodiment.
Figure 4D:
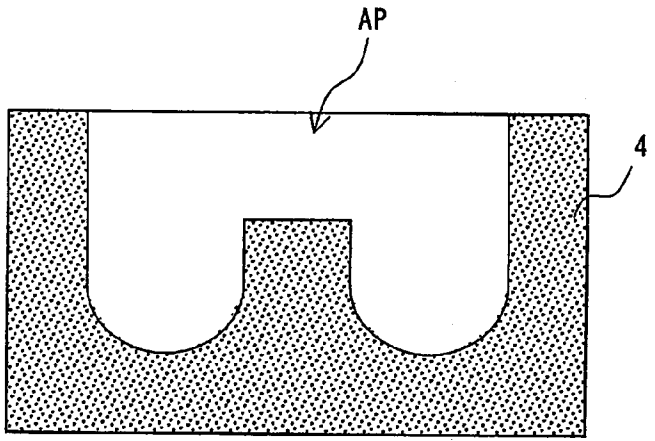
Figure 4B:
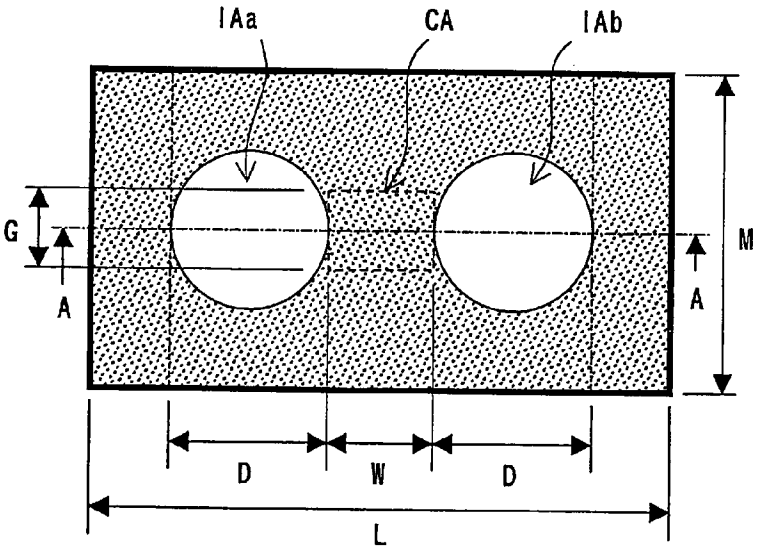
Figure 4A:
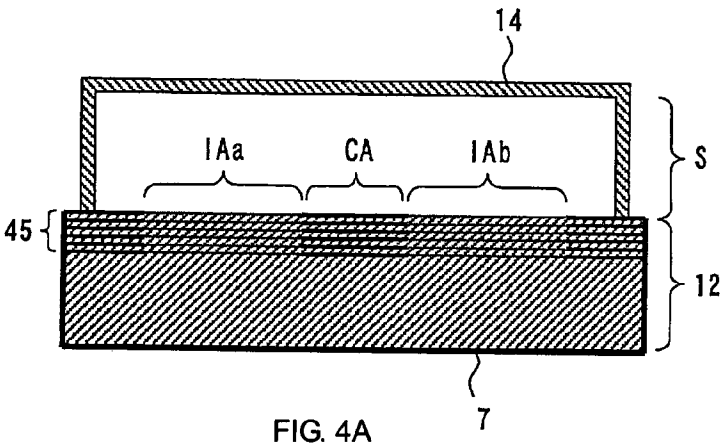

FIG. 4B, is a top view illustrating resonator from which a shielding cap 14 at the top portion (as shown in FIG. 4A) is omitted, and FIG. 4A is a sectional view taken along line A-A in FIG. 4B. FIGS. 4C, and 4D illustrate the patterns of conductor layers formed as the corresponding layers.

As shown in FIG. 4A, a laminated portion 45 in which a plurality of conductor layers and corresponding dielectric layers are alternately laminated is disposed in a multilayered substrate 12. As shown in FIGS. 4C and 4D, the conductor layers 4 and 5 having the two different patterns; they are laminated with a dielectric layer therebetween. That is, this structure corresponds to a structure formed by laminating the laminate structure consisting of the conductor layers 4 and 5 and the dielectric layer 3 shown in FIGS. 1A to 1D in a multilayered form. The conductor layers 4 and 5 are electrically connected to the shielding electrode 7 formed on the four side surfaces and the bottom surface of the multilayered substrate 12. Accordingly, areas free from any conductor layer in the direction in which the dielectric layer and the conductor layers are laminated serve as the inductive areas IAa and IAb. An area where the conductor layers face each other with the dielectric layer therebetween serves as the capacitive area CA. By forming the capacitive area CA by laminating a plurality of conductor layers and corresponding dielectric layers in this manner, the size of the capacitive area can be reduced, and a smaller resonator can be obtained.

By covering the top portion of the multilayered substrate 12 with the conductive shielding cap 14, a shielded resonator having the top space S can be formed.

The multilayered substrate 12 can be manufactured by a manufacturing method for a laminate multilayered substrate including processes of pattern formation by printing a conductive paste on a dielectric ceramic green sheet, and laminating, pressing, and firing of the sheet. Alternatively, a method for sequentially printing dielectric layers and conductor layers on a substrate and then firing the substrate may be employed.

Figure 5B:
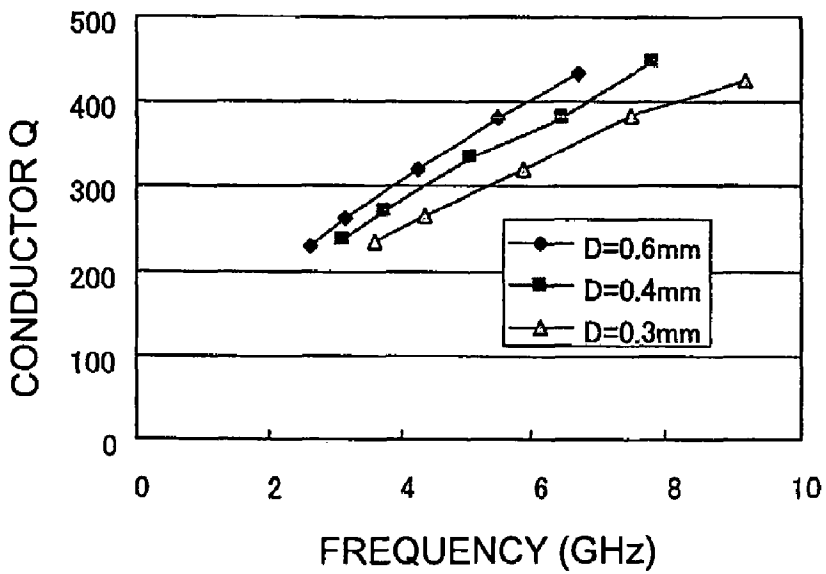
FIGS. 5A and 5B illustrate simulation results of change in the resonant frequency and a change in the conductor Q by using the dimensions of the elements of the resonator shown in FIG. 4 as parameters.
Figure 5A:
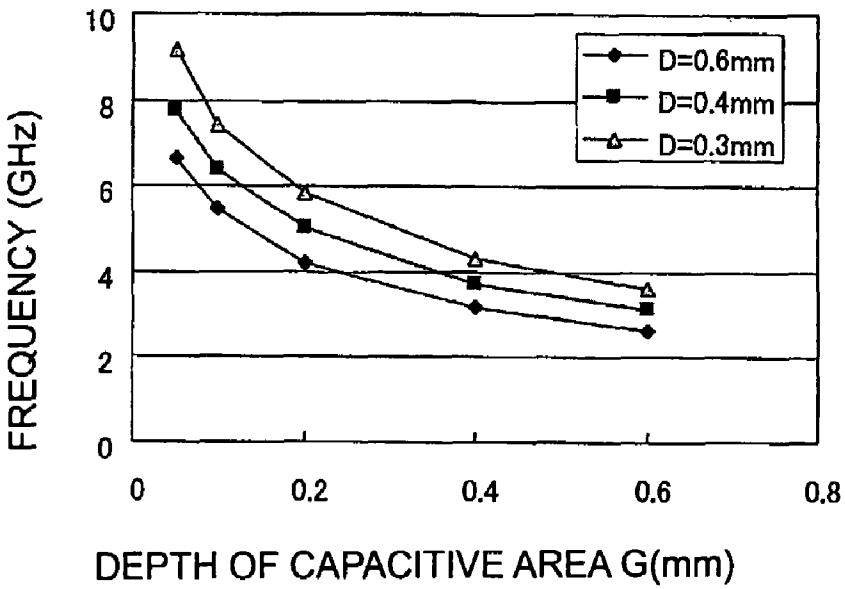

FIGS. 5A and B and 6A and B illustrate simulation results of the resonant frequency and the conductor Q when the dimension parameters of the corresponding elements of the resonator shown in FIG. 4A are changed. For these Figures, the width of the capacitive area CA is indicated by W, the depth of the overlapping portion of the conductor layers is represented by G, and the diameter (opening diameter) of the conductor openings, which serve as inductive areas IAa and IAb, is designated by D. The horizontal length and the vertical width of the multilayered substrate 12 are indicated by L and M, respectively. It is now assumed that L is 2.4 mm and M is 1.2 mm, and that the thickness of the multilayered substrate 12 is 0.5 mm and the thickness of the top space S formed by the shielding cap 14 is 0.5 mm.

FIGS. 5A and 5B illustrate simulation results when G is changed under the three conditions that D=0.3 mm, 0.4 mm, and 0.6 mm by fixing the width W of the capacitive area CA to be 0.4 mm. In 5A, the horizontal axis represents G, and the vertical axis indicates the resonant frequency. In 5B, the horizontal axis represents the resonator frequency, and the vertical axis indicates the magnitude of the conductor loss ("conductor Q).

Since the capacitance is increased in accordance with an increase in the depth G, the resonant frequency is reduced, as shown in FIG. 5A, in inverse proportion to the capacitance. As the opening diameter D becomes larger, the resonant frequency becomes lower. This is because, magnetic fluxes passing through the conductor opening are increased as the opening diameter D becomes larger, thereby increasing the induction quantity.

As shown in FIG. 5B, as the opening diameter D becomes larger, the conductor loss Q at the same frequency becomes higher.

Figure 6B:
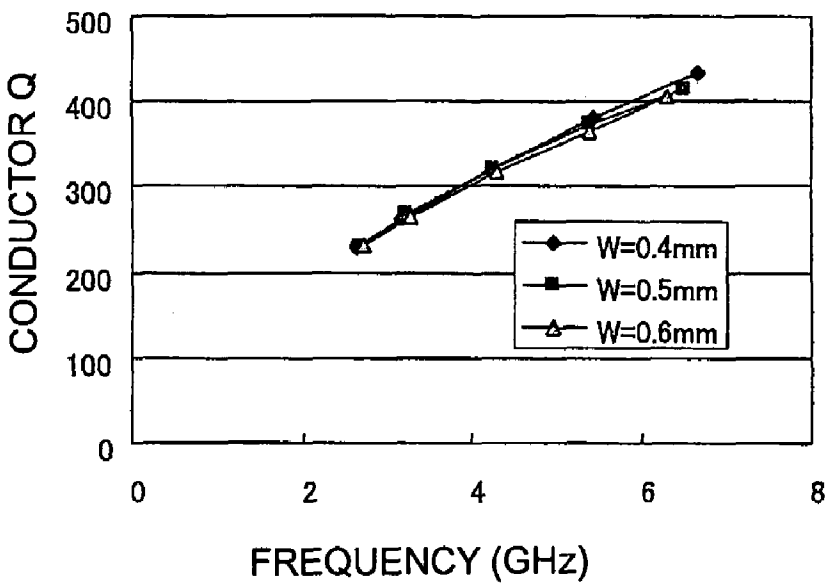
FIGS. 6A and 6B illustrate simulation results of a change in the resonant frequency and a change in the conductor Q by using other dimensions of the elements of the resonator shown in FIG. 4 as parameters.
Figure 6A:
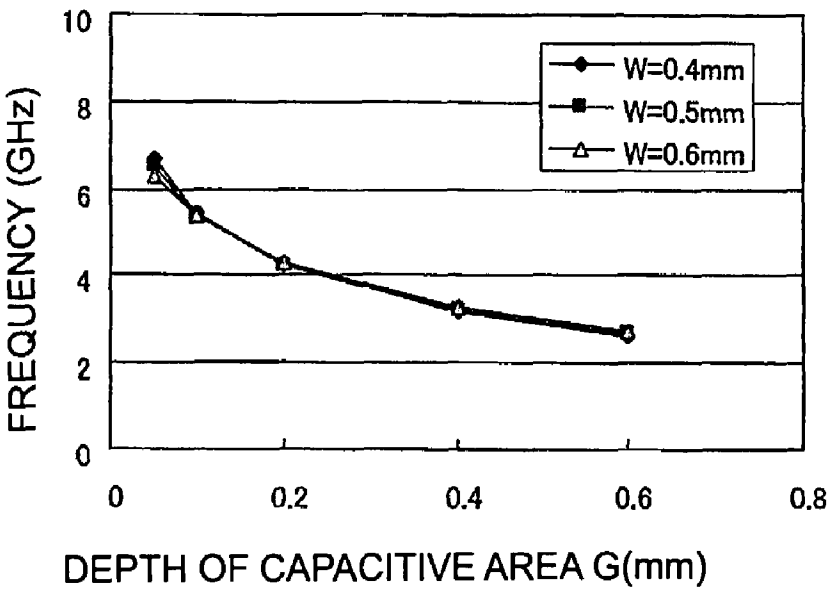

FIGS. 6A and 6B illustrate simulation results when the depth G of the capacitive area is changed under the conditions that the width W of the capacitive area is 0.4 mm, 0.5 mm, and 0.6 mm by fixing the diameter D of the conductor opening to be 0.6 mm. As in FIGS. 5A and 5B, the horizontal axis in FIG. 6A represents G, and the vertical axis indicates the resonant frequency. In FIG. 6B, the horizontal axis represents the resonator frequency, and the vertical axis indicates the conductor loss Q.

Since the capacitance is increased as the depth G of the capacitive area becomes increased, as shown in FIG. 6A, the resonant frequency is reduced in inverse proportion to the capacitance. The dependency of the resonant frequency on the width W of the capacitive area seems to be small. This is probably because the reduced capacitance due to a decrease in the width W of the capacitive area and the increased induction quantity are well balanced.

As shown in FIG. 6B, the dependency of the conductor loss Q on the width W of the capacitive area is not noticeable. This result shows that the conductor loss is not increased even if the width W of the capacitive area is decreased. Thus, the resonator can be miniaturized.

An example of the configuration of a filter according to a fifth embodiment is discussed below with reference to FIGS. 7A to 7E.

Figures 7A, 7B, 7C, 7D, 7E:
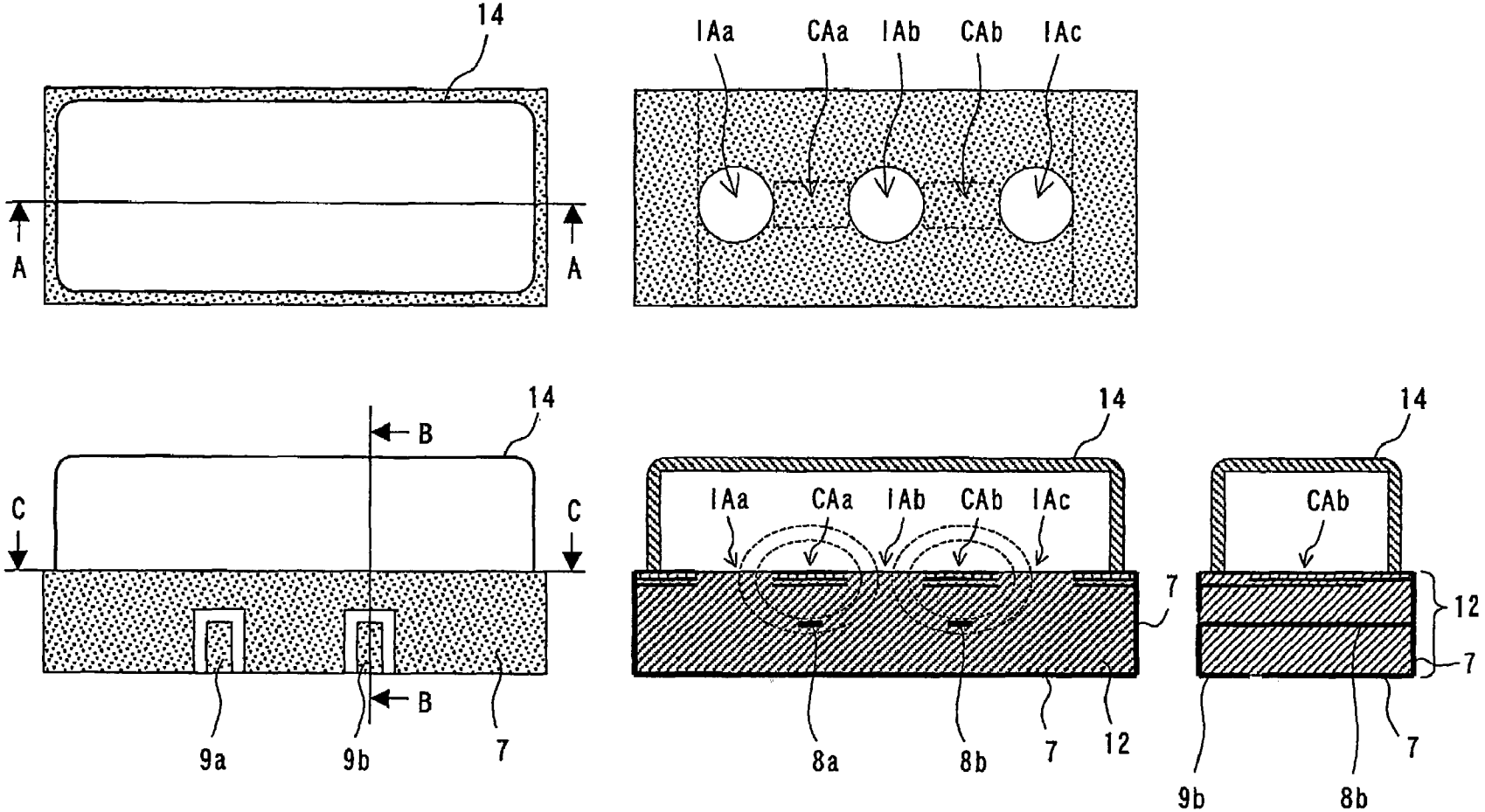
FIGS. 7A to 7E illustrate the configuration of a filter according to a fifth embodiment.

FIG. 7D, is a top view of the filter, and FIG. 7A is a sectional view taken along line A-A in FIG. 7D. FIG. 7E, is a front view of the filter, FIG. 7B is a sectional view taken along line B-B in (E), and (C) is a top view (plan view taken along line C-C in (E)) of the filter from which the shielding cap 14 is removed. In the multilayered substrate 12, a plurality of conductor layers having two different patterns are alternately laminated with a dielectric layer therebetween, as in the structure of the multilayered substrate 12 shown in FIG. 4. With this arrangement, three inductive areas IAa, IAb, and IAc and two capacitive areas CAa and CAb interposed between the inductive areas IAa and IAb and between the inductive areas IAb and IAc, respectively, are disposed.

As shown in FIG. 7A and FIG. 7B, input/output coupling electrodes 8*a* and 8*b* are formed at positions away from the laminated portion of the two conductor layer patterns of the multilayered substrate 12. One end of each of the input/output coupling electrodes 8*a* and 8*b* is electrically connected to the shielding electrode 7 formed at the side surfaces of the multilayered substrate 12, and the other ends of the input/output coupling electrodes 8*a* and 8*b* are electrically connected to input/output terminals 9*a* and 9*b*, respectively. According to this structure, the input/output coupling electrodes 8*a* and 8*b* and the shielding electrode 7 form a coupling loop.

A set of the two inductive areas IAa and IAb and the capacitive area CAa serves as a single (first stage) resonator, and a set of the two inductive areas IAb and IAc and the capacitive area CAb serves as a single (second stage) resonator. The magnetic field distributions of the two resonators are indicated by the broken lines in FIG. 7A, and the input/output coupling electrodes 8*a* and 8*b* are magnetically coupled with the corresponding resonators. Thus, this filter serves as a filter exhibiting bandpass characteristics obtained by two stages of resonators.

Although two stages of resonators are formed in the example shown in FIGS. 7A to 7E, three or more stages of resonators may be similarly formed on a single substrate. In this case, since two inductive areas and a capacitive area interposed between the inductive areas serve as a single resonator, one of the two inductive areas of one resonator is used as one of the two inductive areas of the adjacent resonator. Accordingly, a structure in which the resonators are sequentially coupled with each other can be formed.

A resonator according to a sixth embodiment is described below with reference to FIGS. 8 through 11.

In the first through fifth embodiments, the capacitances of the capacitive areas in the individual layers of the resonators are not specifically indicated. In the sixth embodiment, the capacitances of the capacitive areas in the individual layers are differentiated in the thickness direction.

The configuration of the overall resonator according to the sixth embodiment is similar to that shown in FIG. 7A. The patterns of the conductor layers formed for the corresponding dielectric layers of the multilayered substrate are different from those shown in FIG. 7A.

Figure 8A:
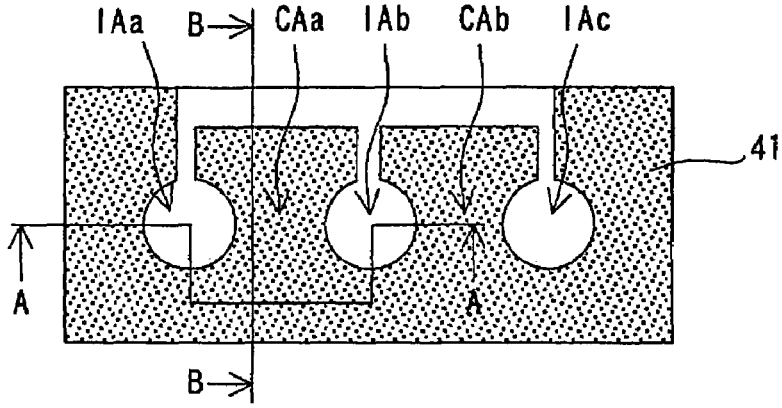
FIGS. 8A to 8E illustrate the configuration of essential portions of a resonator according to a sixth embodiment.
Figure 8B:
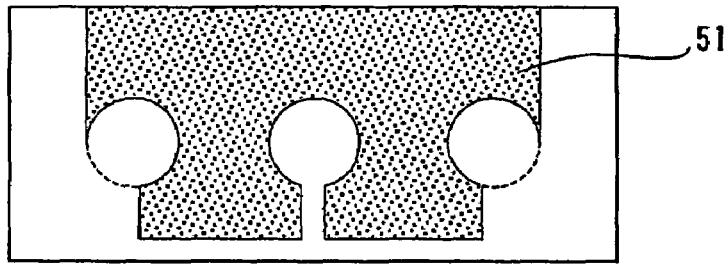
Figure 8C:
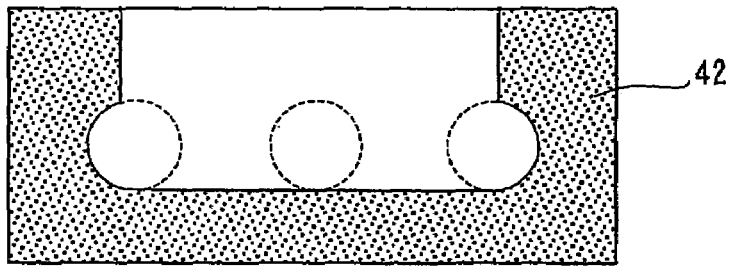
Figure 8D:
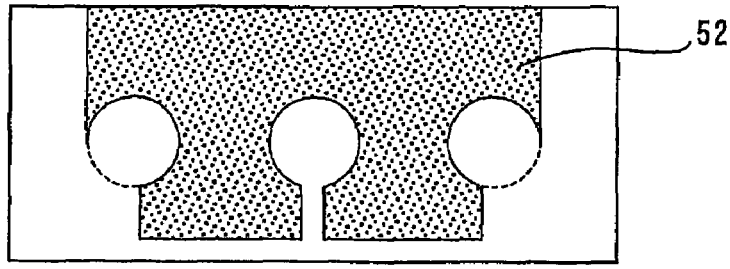
Figure 8E:
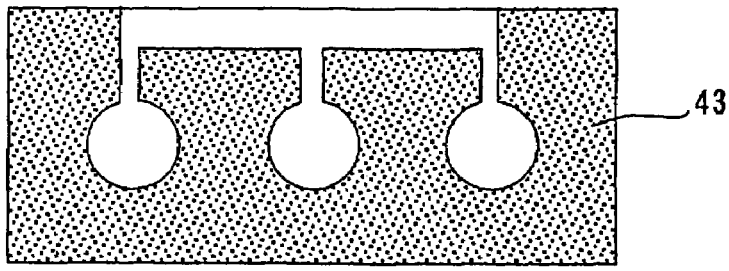

FIGS. 8A to 8E illustrate the patterns of the conductor layers formed for the corresponding dielectric layers of the multilayered substrate. FIG. 8A, illustrate the pattern of a conductor layer as a first layer (topmost layer), FIG. 8B illustrates the pattern of a conductor layer as a second layer, FIG. 8C illustrates the pattern of a conductor layer as a third layer, FIG. 8D illustrates the pattern of a conductor layer as a fourth layer, and (E) illustrates the pattern of a conductor layer as a fifth layer (bottommost layer). Reference numerals 41, 51, 42, 52 and 43 indicate conductor layers.

Figure 9A:
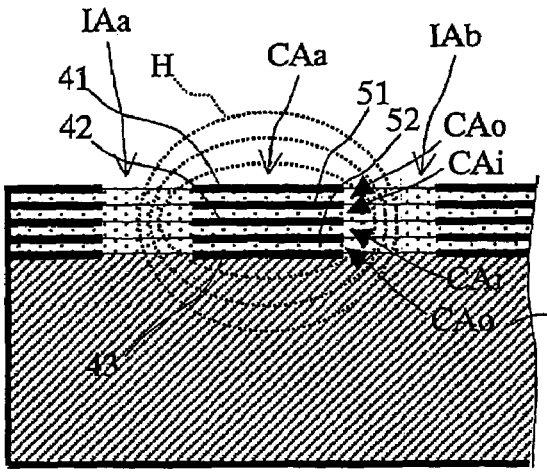
FIGS. 9A to 9D are sectional views illustrating examples of magnetic field distributions in the laminated portions of a plurality of conductor lines.
Figure 9B:
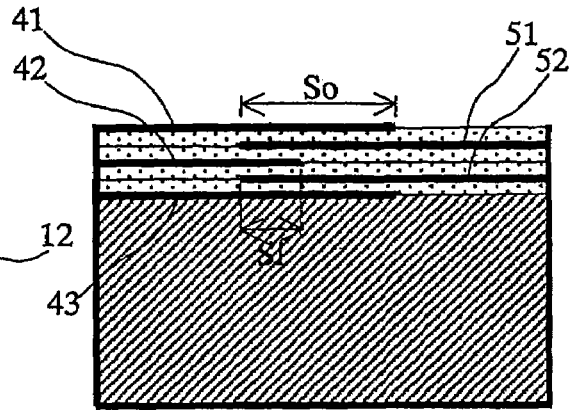
Figure 9C:
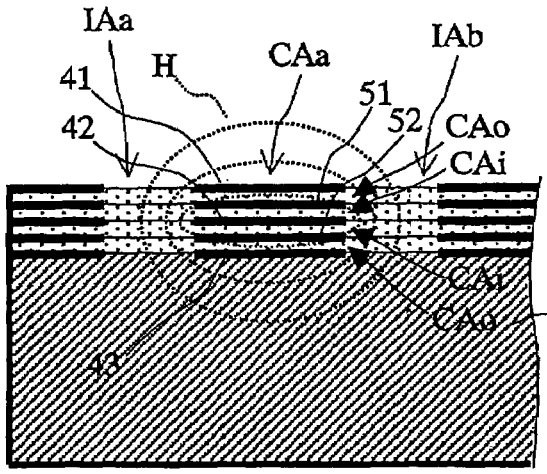
Figure 9D:
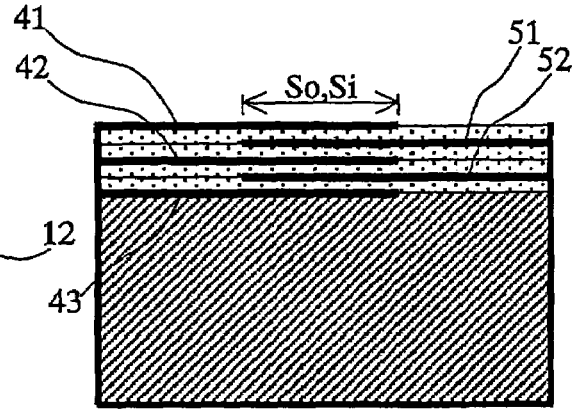

FIG. 9A, is a sectional view taken along line A-A in FIG. 8A. Similarly, in FIG. 9B is a sectional view taken along line B-B in FIGS. 8B. FIG. 9C, and 9D illustrate comparative examples in relation to FIGS. 9A and 9B, respectively, which are discussed below.

In FIGS. 9A and 9C, the broken lines H indicate the distribution of magnetic fields surrounding the capacitive area CAa.

As shown in FIG. 9B, the area of the overlapping portion of the conductor layer 41 as the first layer (topmost layer) and the conductor layer 51 as the second layer is indicated by So, the area of the overlapping portion of the conductor layer 51 as the second layer and the conductor layer 42 of the third layer is represented by Si, the area of the overlapping portion of the conductor layer 42 as the third layer and the conductor layer 52 as the fourth layer is represented by Si, and the area of the overlapping portion of the conductor layer 52 as the fourth layer and the conductor layer 43 as the fifth layer is indicated by So.

In the example of FIG. 9B, the relationship So>Si holds true. That is, the capacitance CAo of the capacitive areas disposed at the outer sides in the laminate direction is set to be greater than the capacitance CAi of the capacitive areas disposed at the inner sides in the laminate direction. In the example of FIG. 9D, the relationship So=Si holds true. That is, the capacitances CAo and CAi of the corresponding layers of the capacitive areas are set to be equal to each other.

Figure 10:
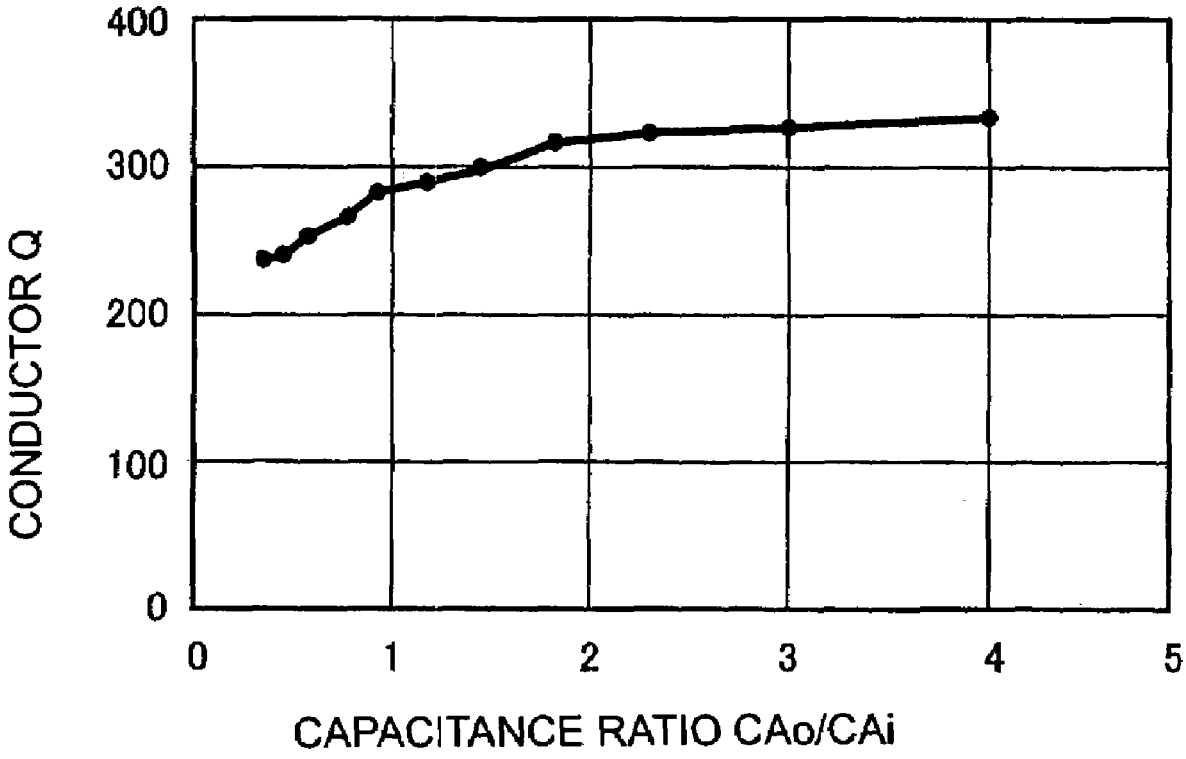
FIG. 10 illustrates the relationship between the conductor Q and the ratio of the capacitance of the capacitive areas disposed at the outer sides in the direction in which a plurality of capacitive areas are laminated to the capacitance of the capacitive areas disposed at the inner sides.

FIG. 10 is a diagram illustrating the relationship between the conductor loss Q and the ratio of the capacitance CAo of the capacitive areas disposed at the outer sides in the direction in which a plurality of capacitive areas are laminated to the capacitance CAi of the capacitive areas disposed at the inner sides in the laminate direction. When CAo/CAi=1, i.e., CAo=CAi, the conductor Q is about 290. When CAo/CAi=4, the conductor Q is improved to about 330. Accordingly, as CAo/CAi becomes greater, the conductor Q (Qc) is improved.

The operational advantages by the improved Qc are discussed below with reference to FIGS. 9A to 9D.

As discussed in the individual embodiments, conductor openings free from any conductor layer in the direction in which dielectric layers are laminated serve as inductive areas, while the portion interposed between the inductive areas where the conductor layers are laminated with the corresponding dielectric layer therebetween serves as a capacitive area. In the resonator formed by the inductive areas and the capacitive area, the intensity of magnetic fields generated in the inductive areas becomes greater as the capacitance of the capacitive area is larger.

When the capacitance of the capacitive areas at the outer sides (outer layers) in the thickness direction is greater than that of the capacitive areas at the inner sides (inner layers) in the thickness direction, as shown in FIGS. 9A and 9B, among the five conductor layers 41, 51, 42, 52, and 43, the current flowing in the outer layers becomes greater than that flowing in the inner layers so that the magnetic fluxes generated by the current flowing in the outer layers becomes greater than those generated by the current flowing in the inner layers. On the other hand, when the capacitances of the capacitive areas of the individual layers are equal to each other, as shown in FIGS. 9C and 9D, substantially the same magnitude of current flows in the five conductor layers 41, 51, 42, 52, and 43, and thus, the magnetic fluxes generated by the current flowing in the inner layers and those generated by the current flowing in the outer layers become substantially equal to each other. Accordingly, the distribution of the magnetic fields surrounding the capacitive area CAa shown in FIG. 9A is expanded farther in the thickness direction compared to the magnetic field distribution shown in If. 9C. In the case of FIG. 9C, the locally circulating magnetic fields intrude into the capacitive areas of the inner layers where the conductor loss is generated.

The relationship among the unloaded Q (Qo), the conductor Q (Qc), and the dielectric Q (Qd) of the resonator is expressed by the following equation (1).

$$\frac{1}{Q_o} = \frac{1}{Q_c} + \frac{1}{Q_d} \tag{1}$$

In equation (1), Qc can be expressed by the following equation (2).

$$\frac{1}{Q_c} = \frac{W_{m1}}{W_{m1} + W_{m2}} \cdot \frac{1}{Q_{c1}} + \frac{W_{m2}}{W_{m1} + W_{m2}} \cdot \frac{1}{Q_{c2}} \tag{2}$$

In equation (2), Qc1 is the conductor Q of the conductor lines of the outermost layers (topmost layer and bottommost layer) of the laminated conductor lines, and Qc2 is the conductor Q of the inner layers, i.e., other than the outermost layers. Wm1 is the magnetic field energy stored in the outermost layers, and Wm2 is the magnetic field energy stored in the inner layers. Since Qc2 is smaller than Qc1 by about two orders of magnitude, Qc can be enhanced by reducing the influence of Qc2 to be smaller than that of Qc1. This can be implemented by decreasing Wm2. To decrease the magnetic field energy Wm2 stored in the inner layers, the current flowing in the conductor lines 21 and 25 of the outermost layers is set to be relatively large in relation to the current flowing in the conductor lines of the inner layers. In order to implement this, the capacitance of the capacitive areas of the outermost layers is set to be relatively large in relation to that of the inner layers.

Figure 11A:
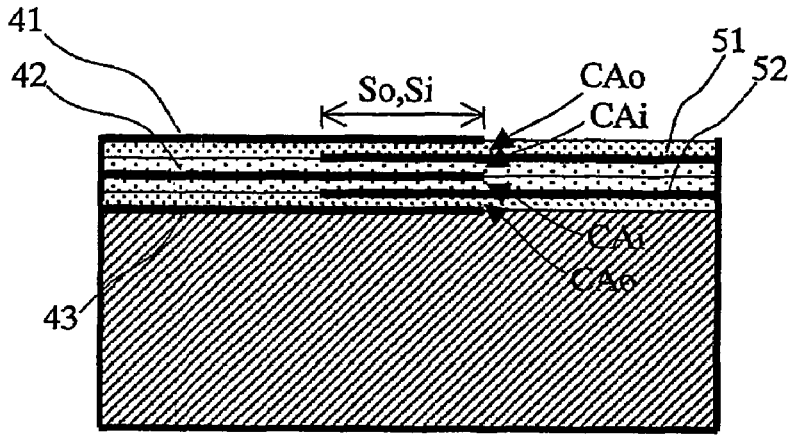
FIGS. 11A and 11B are sectional views illustrating examples of other configurations of the capacitive areas.
Figure 11B:
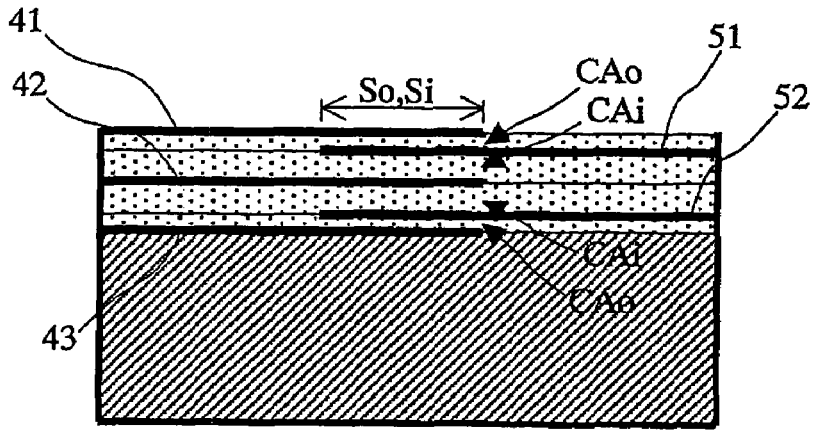

FIGS. 11A & 11B illustrates two examples of the configuration of a resonator in which the capacitance of the outermost layers is greater than that of the inner layers. In FIG. 9B, the distribution of the capacitances in the thickness direction is determined by varying the areas of the opposing portions of the conductor layers. In the example in FIG. 11A, however, the dielectric constant of the dielectric layer sandwiched between the first conductor layer 41 and the second conductor layer 51 is set to be greater than that sandwiched between the third conductor layer 42 and the fourth conductor layer 52. Similarly, the dielectric constant of the dielectric layer sandwiched between the fifth conductor layer 43 and the fourth conductor layer 52 is set to be greater than that sandwiched between the fourth conductor layer 52 and the third conductor layer 42. With this arrangement, the capacitance of the capacitive areas of the outer layers can be larger that of the inner layers.

In the example in FIG. 11B, the thickness of the dielectric layer sandwiched between the second conductor layer 51 and the third conductor layer 42 is set to be greater than that sandwiched between the first conductor layer 41 and the second conductor layer 51. Similarly, the thickness of the dielectric layer sandwiched between the third conductor layer 42 and the fourth conductor layer 52 is set to be greater than that sandwiched between the fourth conductor layer 52 and the fifth conductor layer 43. With this arrangement, the capacitance of the capacitive areas of the outermost layers can be larger than that of the inner layers.

As described above, Qc can be improved by reducing the magnetic field energy intruding into the capacitive areas of the inner layers. The capacitive areas are divided into two groups, i.e., the capacitive areas in the outermost layers and the capacitive areas in the other layers in the above-described examples, to determine the capacitances of the capacitive areas of the layers. Alternatively, the thickness or the dielectric constant of each dielectric layer or the area of the opposing portions of the conductor layers may be determined so that the capacitance is progressively increased as the capacitive area goes from the central portion toward the outer layers.

Figure 12A:
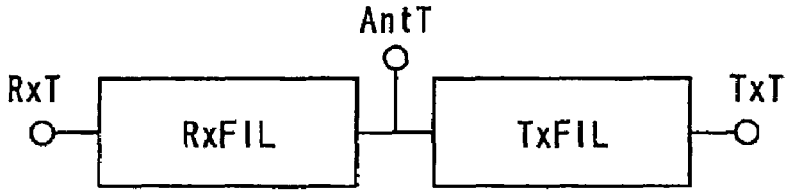
FIGS. 12A and 12B are block diagrams illustrating the configuration of a duplexer and the configuration of a communication apparatus according to a seventh embodiment.
Figure 12B:
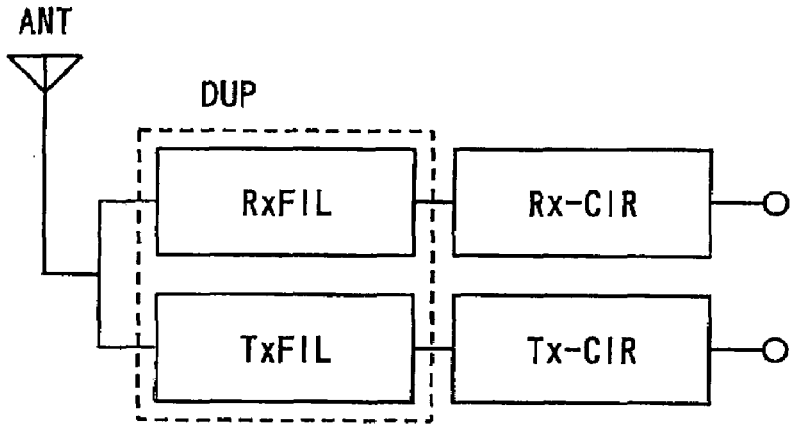

The configurations of a duplexer and a communication apparatus according to a seventh embodiment are shown in FIGS. 12A and 12B.

FIG. 12A, is a block diagram illustrating a duplexer. A transmission filter and a reception filter are each formed of a filter having the configuration shown in FIGS. 7A and 7E. The pass bands of the transmission filter TXFIL and the reception filter RxFIL are designed in accordance with the corresponding bands. The transmission filter TXFIL allows signal components of the transmission frequency band of a signal input from a transmission-signal input terminal TxT to pass through the transmission filter TXFIL to an antenna terminal AntT. The reception filter RxFIL allows signal components of the reception frequency band of a signal input from the antenna terminal AntT to pass through the reception filter RxFIL to a reception-signal output terminal RxT.

In connecting the transmission filter TxFIL and the reception filter RxFIL to the antenna terminal AntT, which serves as a duplexer terminal, phase adjustment is made so that leakage of a transmission signal to the reception filter RXFIL and leakage of a reception signal to the transmission filter TxFIL can be prevented.

FIG. 12B is a block diagram illustrating the configuration of a communication apparatus. As the duplexer DUP, the duplexer having the configuration shown in FIG. 12A is used. A transmission circuit Tx-CIR and a reception circuit Rx-CIR are mounted on a circuit board. The duplexer DUP is mounted on the circuit board so that the transmission circuit Tx-CIR is connected to the transmission-signal input terminal of the duplexer DUP and the reception circuit Rx-CIR is connected to the reception-signal output terminal of the duplexer DUP and so that the antenna ANT is connected to the antenna terminal.

The invention claimed is:

1. A stepped impedance structured resonator comprising: a laminate having superposed set of first, second and third layers; the second layer which is disposed between the first and third layers being a dielectric; each of the first and third layers being conductive layers having spaced first and second non-conductive areas with a first conductive area therebetween; a portion but less than all of the first non-conductive areas of the first and third layers overlapping in the lamination direction and a portion but less than all of the second non-conductive areas of the first and third layers overlapping in a lamination direction to thereby form inductive areas; and a portion of the first conductive areas of the first and third layers overlapping in the lamination direction to thereby form a capacitive area, wherein the shape of the first non-conductive areas of the first and third layers perpendicular to lamination direction are different.

2. The stepped impedance structured resonator of claim 1, wherein the overlapping non-conductive areas are circular.

3. The stepped impedance structured resonator of claim 2, wherein the shape of the first and second non-conductive areas of the first and third layers perpendicular to lamination direction are different.

4. The stepped impedance structured resonator of claim 1, wherein a surface of the third layer is disposed on a surface of a dielectric substrate.

5. The stepped impedance structured resonator of claim 4, wherein a shielding electrode is disposed on at least one outermost surface of the dielectric substrate on which the third layer is disposed.

6. The stepped impedance structured resonator of claim 5, wherein the first layer is covered by conductive cap.

7. A filter comprising a stepped impedance structured resonator of claim 1 having signal input/output means coupled thereto.

8. A communication apparatus comprising a filter of claim 7 coupled to an antenna.

9. A communication apparatus comprising a stepped impedance structured resonator of claim 1 coupled to an antenna.

10. A stepped impedance structured resonator comprising: a laminate having superposed set of first, second and third layers; the second layer which is disposed between the first and third layers being a dielectric; each of the first and third layers being conductive layers having spaced first and second non-conductive areas with a first conductive area therebetween; a portion of the first non-conductive areas of the first and third layers overlapping in the lamination direction and a portion of the second non-conductive areas of the first and third layers overlapping in a lamination direction to thereby form inductive areas; and a portion of the first conductive areas of the first and third layers overlapping in the lamination direction to thereby form a capacitive area, wherein the shape of the first non-conductive areas of the first and third layers perpendicular to lamination direction are different, wherein the laminate contains additional layers disposed to form at least one additional superposed set of said first, second and third layers.

11. The stepped impedance structured resonator of claim 10, wherein one of the layers is a conductive layer in two of the sets in the laminate.

12. The stepped impedance structured resonator of claim 11, wherein at least one of a dielectric constant and a thickness of the second layer in two of the sets are different.

13. The stepped impedance structured resonator of claim 12, wherein a thickness of the second layer in the set disposed at an outermost side in the lamination direction is greater than the thickness of the second layer of another set.

14. The stepped impedance structured resonator of claim 12, wherein a thickness of the second layer in the sets disposed at both outermost sides of the laminate in the lamination direction is greater than the thickness of the second layer of the other sets.

15. The stepped impedance structured resonator of claim 12, wherein a thickness of the second layer in the sets becomes progressively greater from the central-most set toward an outermost side of the laminate in the lamination direction.

16. A filter comprising a stepped impedance structured resonator of claim 12 having signal input/output means coupled thereto.

17. A communication apparatus comprising a filter of claim 16 coupled to an antenna.

18. A communication apparatus comprising a stepped impedance structured resonator of claim 12 coupled to an antenna.

19. A stepped impedance structured resonator comprising: a laminate having superposed set of first, second and third layers; the second layer which is disposed between the first and third layers being a dielectric; each of the first and third layers being conductive layers having spaced first and second non-conductive areas with a first conductive area therebetween; a portion of the first non-conductive areas of the first and third layers overlapping in the lamination direction and a portion of the second non-conductive areas of the first and third layers overlapping in a lamination direction to thereby form inductive areas; and a portion of the first conductive areas of the first and third layers overlapping in the lamination direction to thereby form a capacitive area, wherein the shape of the first non-conductive areas of the first and third layers perpendicular to lamination direction are different, wherein each of the first and third layers have a third non-conductive area which is spaced from the first non-conductive area with a second conductive area therebetween; a portion of the third non-conductive areas of the first and third layers overlapping in the lamination direction, and a portion of the second conductive areas of the first and third layers overlapping in the lamination direction, wherein the shape of the third non-conductive areas of the first and third layers perpendicular to lamination direction are different.

* * * * *